United States Patent [19]

Miller

[11] 3,945,760

[45] Mar. 23, 1976

[54] OUTER CYLINDER FOR A LOW PRESSURE TURBINE APPARATUS

[75] Inventor: Klaus Miller, Douglaston, N.Y.

[73] Assignee: Westinghouse Electric Corporation, Pittsburgh, Pa.

[22] Filed: Oct. 29, 1974

[21] Appl. No.: 518,910

[52] U.S. Cl. ..... 415/189; 415/199 R; 415/201; 29/156.8 R; 415/219 R

[51] Int. Cl.[2] ..... F04D 29/52; F01D 1/02

[58] Field of Search ..... 415/189, 199 R, 219 R, 415/201; 416/201, 219

[56] References Cited

UNITED STATES PATENTS

| | | | |
|---|---|---|---|
| 2,844,304 | 7/1958 | Busquet | 415/201 |
| 3,176,960 | 4/1965 | Sproule | 415/201 |
| 3,386,155 | 6/1968 | Jenkinson | 415/201 |
| 3,603,702 | 9/1971 | Jensen | 415/201 |

FOREIGN PATENTS OR APPLICATIONS

| | | | |
|---|---|---|---|
| 332,579 | 2/1971 | Sweden | 415/201 |

*Primary Examiner*—Henry F. Raduazo
*Attorney, Agent, or Firm*—George M. Medwick

[57] ABSTRACT

An outer cylinder arrangement for a low pressure turbine apparatus. The outer cylinder arrangement surrounds a rotor member having an annular array of blades thereon. A manway opening in the outer cylinder permits access into a diffuser channel disposed within the outer cylinder. The diffuser channel is defined by a bearing cone member integral with the outer cylinder and a flow guide member disposed in spaced relationship from the bearing cone within the outer cylinder. The bearing cone has a removable segment thereon which, when removed, permits axial movement of one turbine blade from the annular array of blades into a volume defined by a removal pocket integral with the bearing cone. The flow guide has a removable segment thereon adjacent to the removable bearing cone segment.

4 Claims, 4 Drawing Figures

OUTER CYLINDER FOR A LOW PRESSURE TURBINE APPARATUS

BACKGROUND OF THE INVENTION

1. Field of the Invention

This invention relates to turbine apparatus and in particular to an improved outer cylinder arrangement for a low pressure turbine apparatus.

2. Description of the Prior Art

As is well known to those skilled in the turbine art, any shutdown of a turbine apparatus for repair or replacement of damaged parts is a major cost to the operating utility. Especially troublesome is the repair and replacement of a damaged rotating blade from the last blade row within a low pressure turbine element.

The rotating blades in the last blade row of the low pressure turbine element are subject to vibratory energies which may sometimes result in damage thereto. In addition, the rotating blades in the last blade row are also subjected to impingement by relatively large water droplets carried by the steam flow. This erosive environment may cause blade damage.

When replacement of damaged blades in the last rotating blade row in the low pressure turbine apparatus is necessary, due to vibration damage, erosion or any other reason, a time consuming and therefore costly shut-down period is required in order to repair the damaged blades. In the prior art, blades in the last rotating blade row in a low pressure turbine apparatus are repairable only after the outer and inner cylinders of the low pressure turbine element is removed.

Removal of the outer and inner cylinders of the low pressure turbine element is required in order to facilitate access to the damaged blades by repair personnel. It is evident therefore, that providing an outer cylinder for a low pressure turbine element which permits removal of damaged turbine blades from the last rotating blade row without necessitating a removal of the outer or inner cylinders of the turbine reduces the period of turbine down-time considerably. This, of course, reduces the period of unavailability of the turbine-generator unit, thus resulting in a significant cost savings.

SUMMARY OF THE INVENTION

The invention relates to an improved outer cylinder arrangement for a low pressure turbine apparatus. The outer cylinder has a bearing cone portion integral therewith. A removable segment of the bearing cone separates a removal pocket contained within the bearing cone from the interior of the turbine apparatus. the removal pocket permits axial movement of a rotating blade from a last rotating blade row thereinto, thus allowing removal of blades from the last rotating blade row to be made with the outer cylinder intact. A flow guide member having a removable portion thereon is disposed within the outer cylinder in spaced relationship from the bearing cone.

It is an object of this invention to provide an improved low pressure turbine outer cylinder which permits removal of low pressure turbine blades without necessitating dismantling of the outer or inner cylinders. It is a further object of this invention to reduce the time necessary for repair or replacement of blades in the last rotating blade row of a low pressure turbine apparatus.

BRIEF DESCRIPTION OF THE DRAWINGS

The invention will be more fully understood from the following detailed description of an illustrative embodiment taken in connection with the accompanying drawings, in which.

DESCRIPTION OF THE PREFERRED EMBODIMENT

Figure 1:
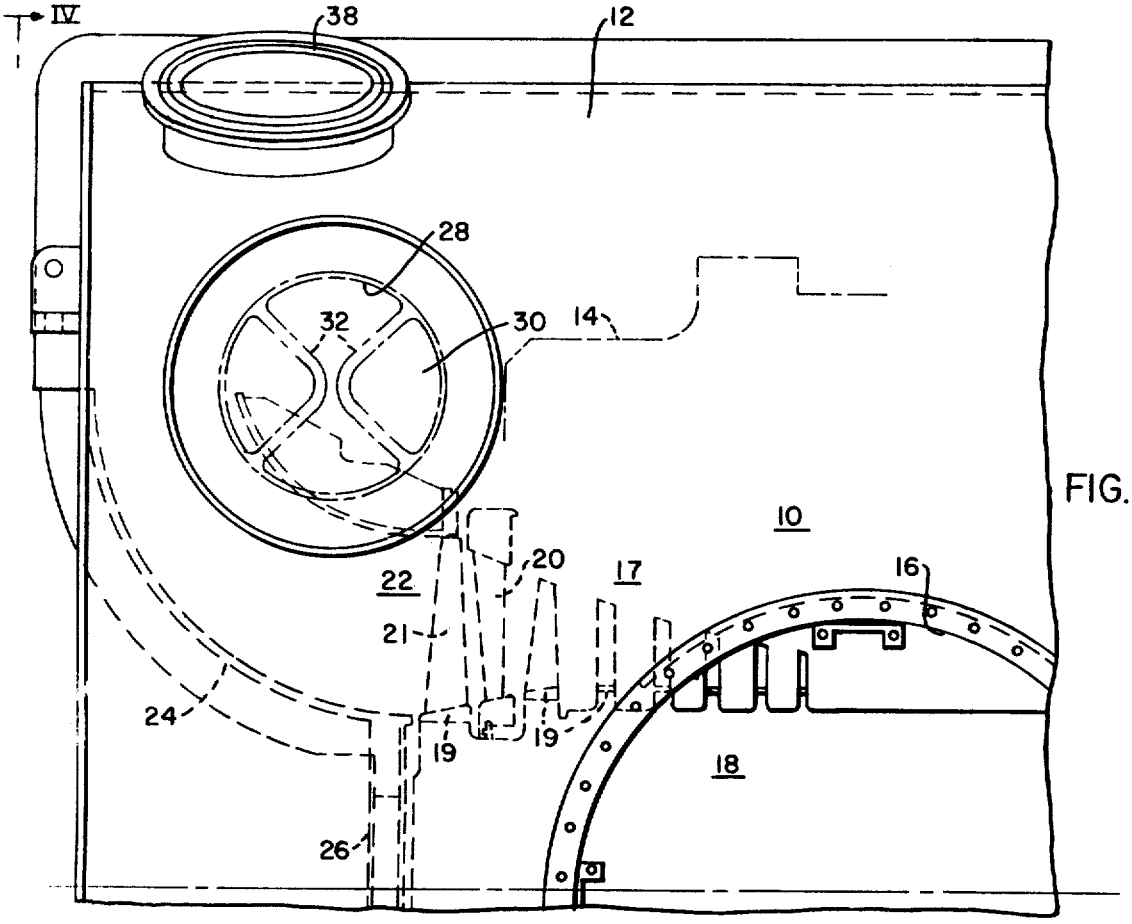
FIG. 1 is a plan view of an outer cylinder of a low pressure steam turbine apparatus.

Throughout the following description, similar reference characters refer to similar elements in all figures of the drawings.

Figure 2:
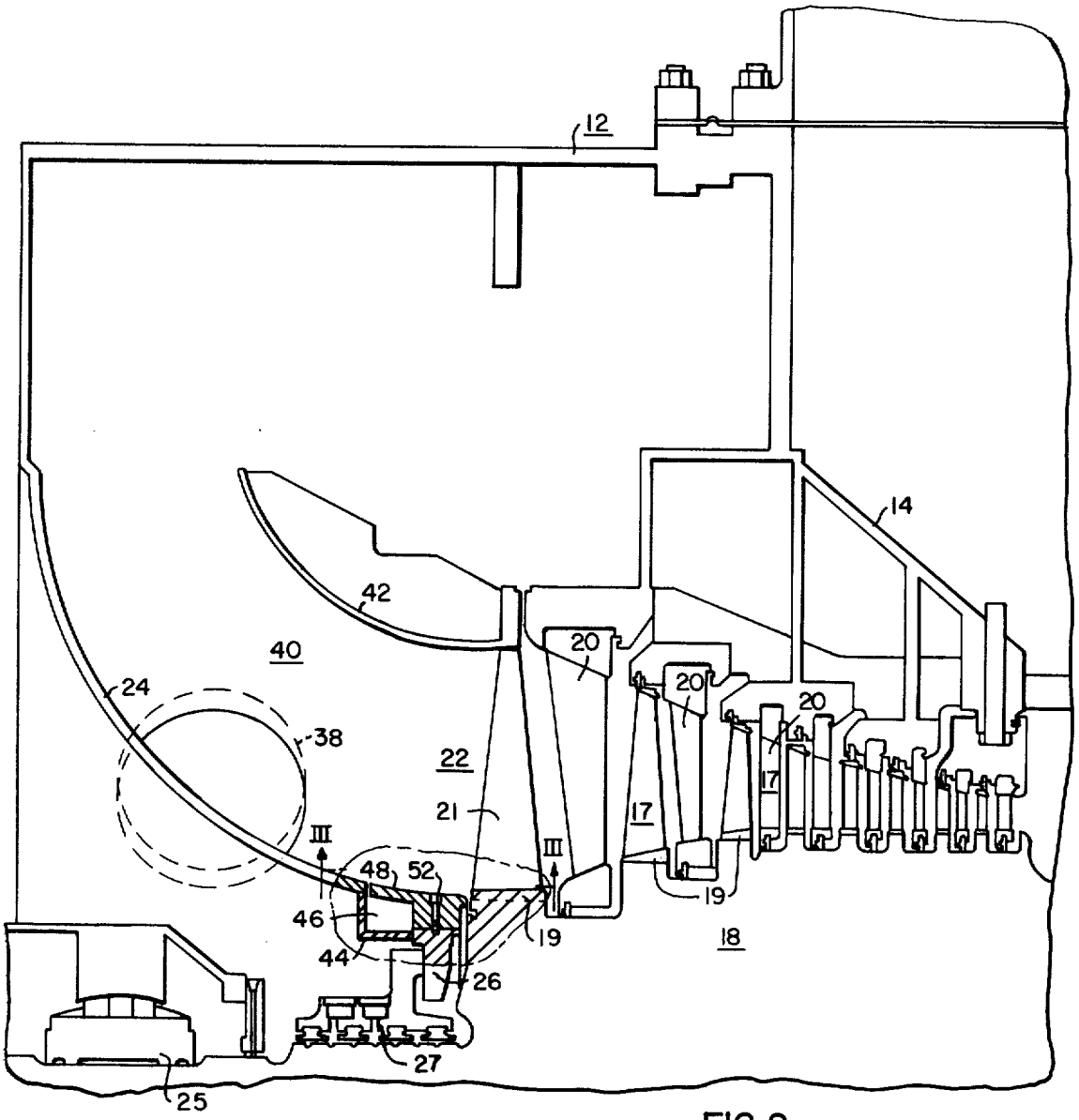
FIG. 2 is a longitudinal view, in elevation, of a low pressure steam turbine apparatus embodying the teachings of this invention taken along lines II—II of FIG. 4.

Referring now to FIGS. 1 and 2, a portion of a low pressure turbine 10 having an outer cylinder cover 12 and an inner cylinder cover 14 is shown. Although a complete cylinder for a turbine apparatus is comprised of a cover portion and a base portion joined together, only the cover portions of the outer cylinder 12 and the inner cylinder 14 are illustrated in the drawings for clarity.

The outer cylinder cover 12 and the inner cylinder cover 14 have an inlet opening 16 therein through which pressurized and heated steam enters the turbine apparatus 10. The steam expands through the turbine apparatus 10 and impinges upon a plurality of annular arrays of rotating blades 17 mounted on a rotor element 18 to produce rotational mechanical energy. The arrays of rotating blades 17 are attached to the rotor element 18 by fastening means 19. The fastening means 19 require axial spacings adjacent to blade rows in order to facilitate removal and repair the rotating blades 17. Intermediate between arrays of rotating blades 17 are arrays of stationary nozzle blades 20, only one such array being shown in FIG. 1.

As is well known to those skilled in the power generation art, damage to the rotating blades 17, especially to those rotating blades 21 in the last rotating blade row 22, occurs due to vibration, erosion, or other causes. When the rotating blades 21 in the last rotating blade row 22 are damaged, the affected blades must be replaced to maintain the maximum possible efficiency or eliminate any unbalances from the turbine 10.

In the prior art, repair or replacement of damaged rotating blades 21 in the last rotating blade row 22 necessitates a total shutdown of the affected turbine. Both the outer cylinder cover 12 and the inner cylinder cover 14 of the turbine 10 must be removed to permit access to the damaged blades. This procedure results in a long period of turbine unavailability and, for that reason, in economically disadvantageous.

Utilization of a turbine outer cylinder 12 embodying the teachings of this invention permits the removal and replacement of damaged blades 21 in the last rotating blade row 22 in the low pressure turbine apparatus 10 without necessitating removal of the turbine outer cylinder cover 12 and inner cylinder cover 14.

The outer turbine cylinder cover 12 has a bearing cone portion 24 thereon, the bearing cone portion 24 being a substantially bell-shaped hood member which permits the location of bearing assemblies 25 (FIG. 2) for the rotor 18 to be placed as close as possible to the last rotating blade row 22. Disposition of the bearing assemblies as close as possible to the last rotating blade row 22 minimizes bearing span. Bearing span is the distance, measure on the rotor 18, between the two bearing assemblies which support the rotor 18. The turbine 10 has a gland support ring 26 integral with the outer cylinder cofer 12 and disposed adjacent the innermost portion of the bearing cone 24. The gland support ring 26 is in close axial proximity to the fastening means 19, commonly serrated root members, of the blades 21 in the last rotating blade row 22. A gland seal 27 (FIG. 2) is disposed near and supported by the gland support ring 26.

An explosiion door 28 is disposed on the turbine outer cylinder cover 12 and has a diaphragm 30 supported by support members 32. The diaphragm 30 and support members 32 are arranged so that the diaphragm 30 separates from the outer cylinder cover 12 to permit fluids trapped within the outer cylinder cover 12 to vent to atmosphere in case the pressure within the outer cylinder cover 12 exceeds a predetermined value, yet prohibit fluids from the atmosphere from entering the interior of the outer cylinder cover 12 during the low pressure operation of the turbine 10.

A manway, or opening, 38 is disposed on the outer cylinder cover 12 adjacent the explosion door 28. The manway 38 permits access to the interior of the outer cylinder cover 12 of the low pressure turbine element 10.

Referring now to FIG. 2, an elevational view, entirely in section, of a portion of the low pressure turbine apparatus 10 is shown. In FIG. 2, the manway 38 provides access to a diffuser channel 40. The diffuser channel 40 is defined by the interior of the bearing cone 24 and a flow guide member 42. The diffuser channel 40 conducts steam which has passed through the interior of the turbine 10 to a condenser element (not shown). The flow guide member 42 has a removable portion which is described more completely herein.

As stated earlier, in the prior art, the last blade row 22 of the plurality of annular arrays 17 of rotating blades on the rotor 18 of the turbine 12 are disposed as close as possible to the gland support ring 26 in order to minimize bearing span. However, such a disposition of the gland support ring 26 is disadvantageous in that it prohibits any axial movement of the blades 21 in the last rotating blade row 22 in a downstream direction, that is, in the direction of the axial flow of steam passing from the inlet 16 toward the diffuser channel 40. Axial movement of blades in the upstream direction is prohibited due to interference by the stationary blades 20 attached to the inner cylinder 14. Therefore, any repair or replacement of rotating blades in the last blade row in the prior art necessitates removal of both the outer cylinder cover and the inner cylinder cover.

This invention discloses a turbine outer cylinder 12 having a removable member disposed on the interior of the turbine 10, which when removed, provides a removal space within the cylinder 12 that is axially adjacent the blades 21 in the last rotating blade row 22. The space provided by removal of the member is sufficient to permit axial movement of a blade 21 thereinto, while the outer cover 12 and inner cover 14 remain intact. A blade 21 which can be unfastened or axially removed given the space provided axially downsttream is utilized in a turbine embodying the teachings of this invention. Such an improved rotating turbine blade is disclosed and claimed in the copending application of Warner, Healy and Grijalba, Ser. No. 518,909, filed Oct. 29, 1974, (W.E. Case 43,994) and assigned to the assignee of the present invention.

Figure 3:
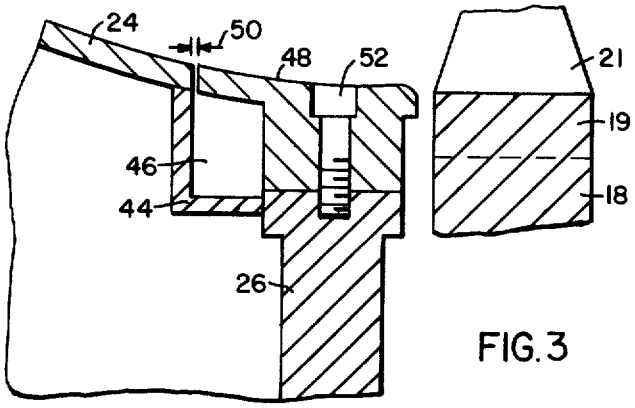
FIG. 3 is an enlarged view showing a portion of the low pressure stream turbine apparatus embodying the teaching of this invention; and, FIG. 4 is a view of the turbine taken along lines IV—IV in FIG. 1.

In FIGS. 2 and 3, a pocket structure 44 is shown extending between the bearing cone 24 and the gland support ring 26. The pocket structure 44 defines a removal pocket or space 46. The removal pocket 46 provides sufficient axial space downstream of the last blade row 22 to permit axial movement of either the rotating blades 21 or blade fastenings devices thereinto. The removal pocket 46 is bounded on the interior of the turbine cylinder 10 by a removable bearing cone segment 48. The removable bearing cone segment 48 is separated from the remainder of the bearing cone 24 by a narrow gap 50. The removable bearing cone segment is mounted on the gland support ring 26 integral with the outer cylinder cover 12 by suitable mounting means, such as the screw 52. It is understood that the removable bearing segement 48 may completely fill the space 46 while attached to the gland support ring 46 yet be within the contemplation of this invention.

It will be observed that the removable bearing cone segment 48 is disposed as close to the rotating blades 21 of the last rotating blade row 22 as the bearing cones of the prior art. It is also to be observed that the removable bearing cone segment 48 is fabricated so as to avoid abrupt changes and irregularities in the diffuser channel 40, thus maintaining smooth flow in the area of the removable bearing cone segment 48. The pocket structure 44 is securely affixed and sealed to the bearing cone 24 and the gland support ring 26 to insure that fluid leakage from the interior of the turbine 12 through the gap 50 is prevented.

Withdrawal of the mounting means 52, which secures the removable bearing cone segment 48 to the gland support ring 26, and the removal of the removable bearing cone segment 48, provides the removal pocket 46 which permits axial movement of rotating blades 21 from the last rotating blade row 22 thereinto. Thus, damaged blades 21 in the last rotating blade row 22 can be withdrawn into the removal pocket 46 and extracted from the interior of the turbine 12 without necessitating the dismantling of the outer cylinder cover 12 and the inner cylinder cover 14. It is to be understood that any apparatus or method which utilizes a removal pocket or provides a space within the turbine to permit axial movement of either a rotating blade from the last rotating blade row or axial movement of a blade fastening means for a last row rotating blade is within the contemplation of this invention.

Figure 4:
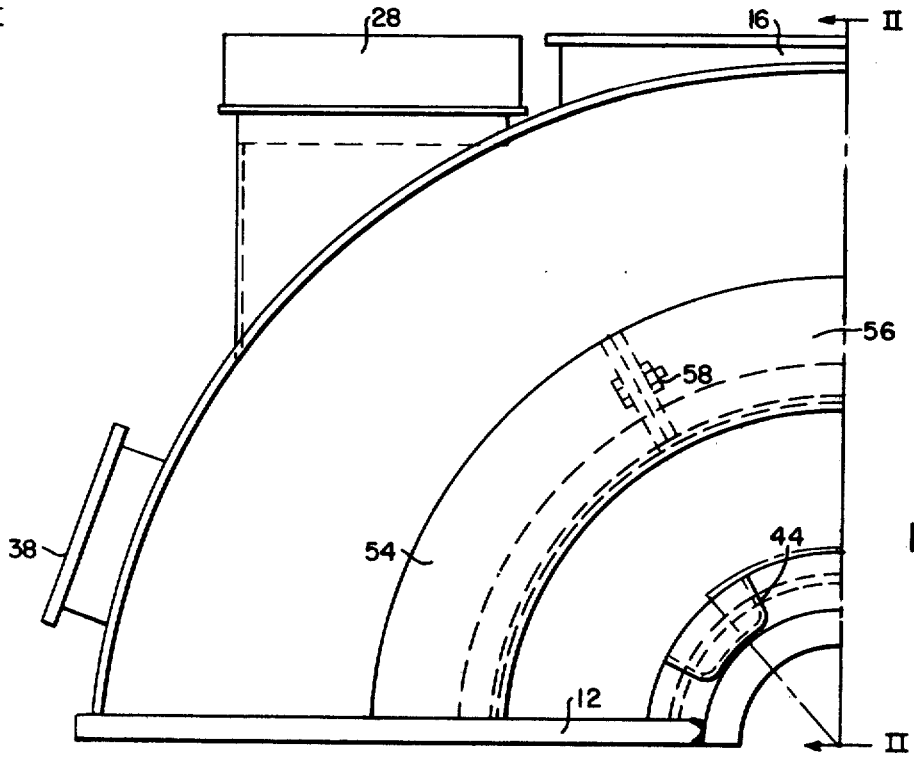

Referring now to FIG. 4, an elevation view of a portion of the low pressure turbine 12, taken along lines IV—IV in FIG. 1 is shown. In FIG. 4, the removal pocket structure 44 is disposed at a predetermined position on the bearing cone 24. The removable bearing cone segment 48 (FIGS. 2 and 3) of the bearing cone 24 is disposed on that portion of the bearing cone 24 surrounded by the removal pocket structure 44.

In the prior art, the flow guide member 42 is usually fabricated of two sutstantially semicircular members which meet along the horizontal centerline of the turbine apparatus to provide an integrated flow guide member. In the flow guide 42 taught by this invention, one of the substantially semicircular members is shown as being segmented into a first flow guide segment 54 and a second flow guide segment 56. The first segment 54 is connected to the second flow guide segment 56 by suitable connection means, such as a bolt 58. The first segment 54 is less than half of the flow guide member 42.

The first flow guide segment 54 is affixed to the second segment 56 by the bolt 58 in such a manner that the bolt 58 is able to be removed by repair personnel from within the outer cylinder cover 12. Of course, entry into the outer cylinder cover 12 is effected by passage through the manway 38, which is disposed on that portion of the turbine outer cylinder cover 12 closest to the first flow guide segment 54. In addition, the explosion door 28 is also positioned on the outer cylinder cover 12 so as to be near the first flow guide segment 54.

If, for any reason, it becomes necessary to repair or replace one of the blades 21 in the last rotating blade row 22, it is possible to effect such repairs without dismantling the outer cylinder cover 12 and the inner cylinder cover 14 of the turbine 10.

Repair or replacement of one of the blades in the last rotating blade row may be accomplished as follows: After allowing sufficient time to permit the turbine 12 to cool, workmen can gain entry into the diffuser channel 40 through the manway 28 (FIG. 3). Once inside the diffuser channel 40, the repair personnel can proceed within the diffuser channel 40 to the point of attachment of the removable bearing cone segment 48 to the gland support ring 26 integral with the outer cylinder cover 12. Of course, the point of attachment between the removable bearing cone segment 48 and the gland support ring 26 may be accessible from outside the turbine outer cylinder 12.

The diffuser channel 40, between the flow guide member 42 and the bearing cone 24, varies depending upon the size of the turbine 10 involved. It is obvious that working conditions may be inhibited, if not entirely restrained, within the diffuser channel 40 of smaller sized turbines. However, the bolt 58 which secures the first flow guide segment 54 to the second flow guide segment 56 is accessible and able to be removed from within the outer cylinder cover 12. It is thus seen that ample work space within the diffuser channel 40 can be obtained if the first flow guide segment 54 is removed.

Once the bolt 58 is withdrawn, and other attachment features of the flow guide 42 not related to the invention are removed, a crane or hoist can be extended into the inner cylinder cover 14 through the explosion door 28. At this point, the first flow guide segment 54 is lifted away from the remainder of the flow guide 42 and, for convenience, is usually located at a predetermined position away from the area of repair work. Of course, repair personnel may work within the diffuser channel 40 of a larger turbine apparatus without removal of the first flow guide segment 54.

It is thus seen that removal of first flow guide segment 54 provides an ample work area within the turbine outer cylinder cover 12 for repair personnel. Referring again to FIG. 2, it is seen that the repair crew within the expanded work area is easily able to remove the screw 52 which secures the removable bearing cone member 48 to the gland ring 26. With the screw 52 removed, the removable bearing cone member 48 is able to be withdrawn from the repair area, and the removal pocket 46 is exposed to the interior of the turbine 12. Any configuration or method by which the removable bearing cone segment 48 is removed from outside the turbine 10 to provide the removal pocket 46 within the outer cylinder 12 of the turbine 10 is also within the contemplation of this invention.

The work crew rotates the rotor 18 so that the damaged rotating blade 21 in the last rotating blade row 22 is directly adjacent to the removal pocket 46. The workmen can then proceed to remove damaged rotating blade 21. This is accomplished as follows:

After the damaged blade 21 from the last rotating blade row 22 has been prepared for removal, the damaged blade 21 is moved axially downstream into the removal pocket 46. The volume of the removal pocket 46 provides sufficient axial space to permit movement of a damaged rotating blade 21 completely into the removal pocket 46. After the damaged blade 21 is completely moved axially into the removal pocket 46, it is taken out of the turbine 12 and a replacement blade is passed to the workmen inside the turbine 12. Before inserting the new rotating blade, the root groove in the rotor 18 from which the damaged blade has been extracted is inspected and cleaned.

The replacement blade is inserted into the removal pocket 46 and moved axially into the turbine 12. The replacement blade is thus engaged into the root groove on the rotor 18. Once the rotating blades 21 are secured, and the replacement operation is finished.

The provision of the removal pocket 46 within the turbine outer cylinder 10 permits axial movement of the turbine blade 21 thereinto, thus enabling damaged rotating blades 21 from the last rotating blade row 22 to be replaced without necessitating removal of the turbine outer cylinder cover 12 or iner cylinder cover 14. Such repair is economically advantageous in that it appreciably shortens the period of unavailability of the turbine 12 usually necessary for turbine repair.

After the rotating blades have been secured, the removable bearing cone segment 48 is mounted again on the bearing face 26 and the screw 52 reinserted. The workmen then resecure the bolt 58 to reconnect the first flow guide segment 54 to the second flow guide segment 56. The repair crew exits the apparatus through the manway 38, thus completing the repair operation.

It is seen that the provision of the removal pocket 46 and the removable bearing cone member 48 provides a useful working volume into which rotating blades 21 from the last rotating blade row 22 can be axially moved, thus permitting replacement of such blades 21 without necessitating removal of the outer cylinder 10. It is also seen that the disposition of a flow guide member 42 having a separable first segment 54 and second segment 56 provides ample work area to permit repair personnel to repair or replace damaged rotating blades from the last rotating blade row. It is apparent that utilizing the teachings of this invention eliminates an appreciable portion of turbine unavailability due to repairs. The quicker repair time is directly equatable to an increased economic advantage for the user of a turbine embodying the teachings of this invention.

I claim:

1. An outer cylinder for an axial flow turbine apparatus, said cylinder having a bearing inner cone portion and a gland support ring thereon, said cylinder surrounding a rotor having a rotating blade thereon, said cylinder comprising:

a sealed pocket structure formed in said bearing inner cone portion and said gland support ring, and, a removable member attached to the interior of said outer cylinder over said pocket, said removable member comprising a segment of said bearing inner cone, whereby the removal of said segment exposing said pocket within said cylinder adjacent to said blade in the direction of axial flow while said cylinder is surrounding said rotor, said pocket being of sufficient size to permit axial movement of a portion of said blade thereinto for the removal of the rotor blade.

2. The outer cylinder of claim 1, wherein said, cylinder has a flow guide member disposed therein, said flow guide and said bearing inner cone defining a diffuser channel within said cylinder, said channel communicating with said space provided when said segment is removed.

3. The outer cylinder of claim 2, wherein said flow guide member has a removable portion thereon, said removable portion of said flow guide being less than one-half of said flow guide member, said removable portion of said flow guide being adjacent to said segment of said bearing inner cone.

4. The outer cylinder of claim 1, wherein said sealed pocket structure is disposed at one predetermined location on said outer cylinder.

* * * * *